United States Patent [19]

MacLennan

[11] 4,298,014

[45] Nov. 3, 1981

[54] HAIR PROCESSING SHIELD

[76] Inventor: Jean MacLennan, 115 Lafayette Rd., Northampton, N.H. 03862

[21] Appl. No.: 121,050

[22] Filed: Feb. 13, 1980

[51] Int. Cl.[3] ..... A45D 1/00

[52] U.S. Cl. ..... 132/9

[58] Field of Search ..... 132/9, 39, 41

[56] References Cited

U.S. PATENT DOCUMENTS

| | | | |
|---|---|---|---|
| 2,957,480 | 10/1960 | Widoff et al. | 132/9 |
| 3,103,933 | 9/1963 | Sanzo | 132/9 |
| 3,595,247 | 7/1971 | Campana | 132/9 |
| 3,610,257 | 10/1971 | Hall | 132/9 |
| 3,692,032 | 9/1972 | Regas | 132/9 |
| 3,726,289 | 4/1973 | Thompson | 132/9 |

*Primary Examiner*—G. E. McNeill

*Attorney, Agent, or Firm*—Strimbeck, Davis & Soloway

[57] ABSTRACT

A hair processing shield to assist tinting, coloring and bleaching comprises a cylinder or tube of a clear polyolefin film. The tube is sized to fit over the head and cover the hair. The tube has longitudinal lines of perforations that are torn apart to form tabs. The tabs are then folded down to form pockets around portions of the hair pulled through the film and treated with a hair treating solution.

This shield and hair treating procedure permits the hairdresser to segregate strands of hair for treatment, protects the head of the client and prevents drying or loss of the treating solution.

8 Claims, 2 Drawing Figures

HAIR PROCESSING SHIELD

PRIOR ART

Reference is made to the patents of Cortez, U.S. Pat. No. 2,857,917 and to Widoff, U.S. Pat. No. 2,957,480 which relate to this method of treating hair.

INTRODUCTION

It has been the practice for some time in hairdressing to place a covering of a plastic film over the head and to pull tufts of hair through perforations in the covering to be tinted or bleached. The plastic covering through which the tufts are pulled serves to protect the head of the user from the harsh chemicals treating the hair and to segregate the tufts of hair from the remaining hair so that very definite streaking or tinting can be obtained.

Various methods have been used to protect the tufts of hair with the treating solution on them to prevent their drying out. Most commonly a second covering or plastic bag is pulled over the client's head as for example is shown by cap 30 in U.S. Pat. No. 2,957,480.

There has been some resistance by hairdressers to the use of creative coloring techniques because often they result in a creative disaster. The gell type of peroxide for example can be difficult to handle as it is sticky and gooey or runny and does not stay in place. This causes a lack of control by the hairdresser and inability to restrict the treatment to selected tufts. The use of a cap or second covering to encase the tufts interferes with the hairdresser's ability to see and treat precisely. Also, the cap tends to make the client uncomfortable as the hair pulls and tangles.

A hairdresser can substantially increase sales if he has a convenient and efficient way of reliably tinting, coloring, bleaching, or otherwise treating hair.

THIS INVENTION

The present invention is a hair processing shield and method of using it that simplifies and facilitates the treating of selected portions of a head of hair. The present invention provides a plastic bag of a thin flexible polyolefin film that fits over a head of hair and is provided with perforations which when separated yield flaps that can be turned down and folded under to form pockets that encase selected portions or tufts of hair pulled through the bag in a conventional manner, e.g. as with a small crochet hook, for treatment. The treating solution is then applied to the hair and a flap created by tearing the perforations in the bag is folded over the wetted tuft of hair to form a pouch which is then clipped or held together for whatever length of time is necessary to accomplish the treatment. The pouches formed in this manner prevent the hair tufts from drying out and help contain the treating solution so that it does not drip or flow away from the tufts of hair.

The present procedure saves time for the hairdresser and allows her to very selectively treat only the hair strands she wants to treat. This gives her the freedom to use more than one color at a time with each being protected in its own plastic pouch.

In brief compass, this invention is a bag to be used in hairdressing or treatment comprising a tube of a water insoluable preferably clear flexible membrane open at one end and having a diameter sufficient to encase the hair from the neck to the top of the head. The flexible membrane is readily penetrable by a small hook which hook is used to pull tufts of hair through the resulting puncture in the flexible membrane. According to this invention, the tube has a circumferential line of perforations that can be parted by hand near one end forming thereby a tearable tab at that end. It has at least 2, preferably at least 3, spaced apart longitudinal lines of like perforations extending from the circumferential line of perforations towards the mid-portion of the tube. The longitudinal lines of perforations are spaced apart at least 3 inches and have a length of at least 3, preferably 5 inches. In use when a hairdresser wishes to create a pocket he tears the tab created by the circumferential line of perforations and then tears down the tab formed by two adjacent lines of longitudinal perforations which tab can then be folded down to form the pocket over the tufts of hair being treated.

The bag can, of course, also be used whole without tearing the perforations with tufts of hair being pulled therethrough, treated and a second like bag placed thereover. Further, the tube or bag can be used over conventional permanent wave treatments to hold in the vapors and warmth, with the circumferential perforations being torn and the end tab removed near the end of the treatment to allow the vapors and heat to gradually escape without shocking the hair. Also, a small hot air hose or blower can be attached to the bag as by making an opening in the bag and taping the hose therein; thus the bag can be used as a hair dryer. In some instances the tabs instead of just being folded down can be cut free and used to wrap tufts of hair or be stuck down with tape over areas not conveniently reached by simply folding down the tab.

THE DRAWINGS

DESCRIPTION

Figure 1:
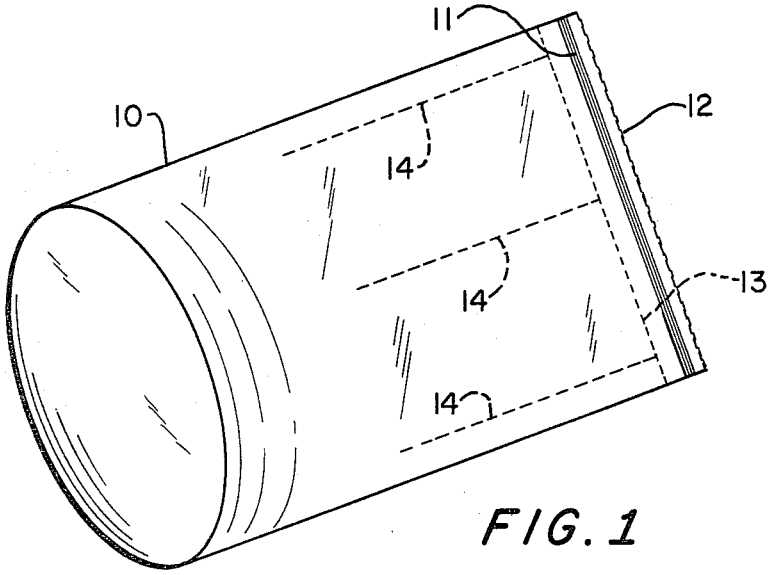
FIG. 1 is a perspective view of the plastic tube of this invention.

With reference to FIG. 1, shown is a tube 10 or cylinder of a flexible, waterproof plastic film perferably of a polyolefin such as polyethylene having a thickness of 3 mils (0.003 inches) or less, preferably 1 mil or less. The plastic tube has a diameter in the range of 10 to 16 inches and a length in the range of 10 to 20 inches. One end of tube is heat seated together along a line 11. The bag can be supplied precut flat or in a roll of bags much like plastic bags are provided shoppers for fruit and vegetables at supermarkets. In the latter case, the tear line 12 between bags must be weaker than the tab tear line 13. This tab tear line 13 is a circumferential line of perforations which as illustrated completely encircle the cylinder but can in some instances only go part way around. Perforations 13 create a tearable tab at the top of the cylinder which tab can have a width in the order of 1 to 3 inches.

Extending from perforation 13 are a series of longitudinal perforations 14 that run towards the mid-portion of the cylinder. There are at least 3 spaced apart lines of longitudinal perforations and there can be as many as 5 or 8. Six equally spaced longitudinal lines of perforations are preferred.

While it is much preferred to supply the bag closed at one end as illustrated, it can be supplied open at both ends in which case when one wishes to use the bag with one end closed a rubber band or clip will have to be placed over the end. Further, while not illustrated, a like or matching set of circumferential and longitudinal perforations can be placed at the other end of tube 10.

While it may be, the bag is preferably not perforated in the areas where tufts of hair are to be pulled through. Such preperforating decreases the versatility of the bag and permits the loss of fumes and liquids.

Figure 2:
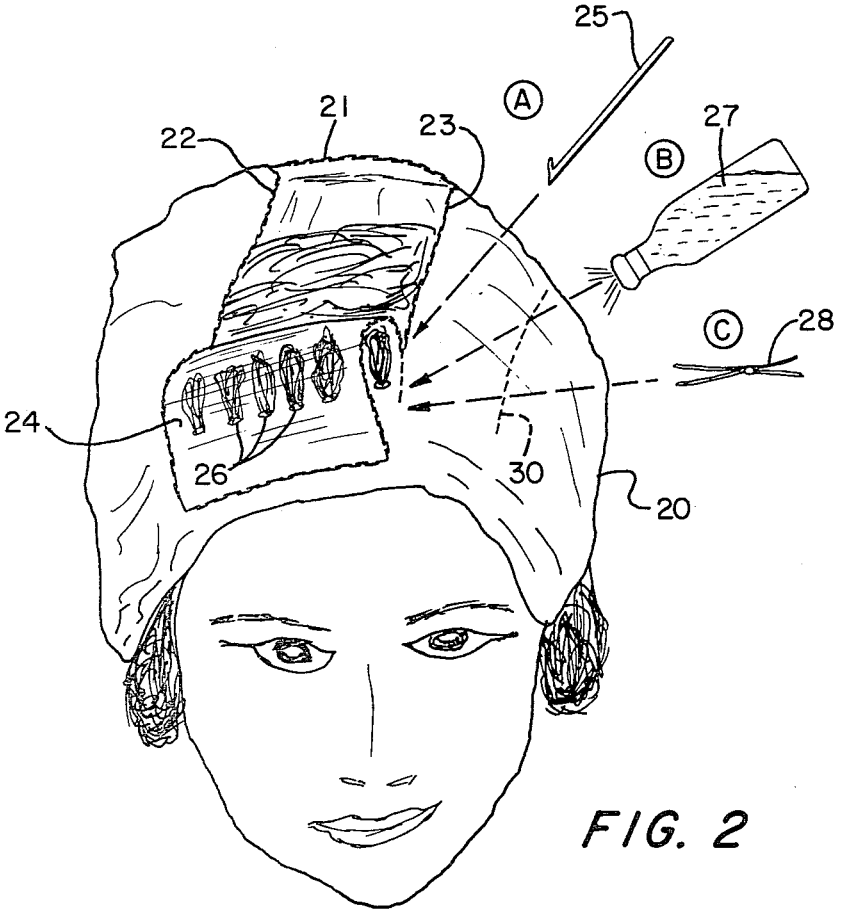
FIG. 2 is an illustration of the hair tinting shield of this invention in use on a client's head.

FIG. 2 shows a hair tinting shield 20 of this invention in use. The shield has been pulled over the head of a client and a flap 24 has been created by tearing off the top tab at the circumferential line 21 of perforations and tearing down at longitudinal perforations 22 and 23. As illustrated, there is a 3rd line of longitudinal perforations 30 which has not been utilized.

A hook 25 in a first step A as shown by the arrow is used to puncture bag 20 to give perforations 26 and to pull tufts of hair through the resulting punctures for treatment. This is while flap 24 is up and out of the way. Thereafter, a treating solution 26 in a second step B is applied as shown by the directional arrow to the tufts of hair thus isolated following which flap 24 is folded down over the tufts of hair thus isolated following which flap 24 is folded down over the tufts being treated forming a pocket thereabouts. This pocket is clipped or held down as may be convenient in a third step C. Clips 28, as indicated by the directional arrow, is slipped over both sides and end of the pocket at the base or underneath the line of the tufts of hair.

After sufficient time has passed the shield 20 is removed and disposed of and the hair is further washed and treated as desired. Since the plastic bag is quite inexpensive, there is no compunction against throwing it away and this makes the processing more neat and sanitary. The procedure of this invention eliminates the necessity of having to use a second bag over the tufts of hair pulled through a first bag. It also allows the hairdresser to check the tufts of hair as they are processed by sections without need to disrupt the whole treatment and to remove treating solution from any section by wiping or blotting away the treating solution to prevent over treatment.

As can be appreciated, while it is preferred to use clear relatively transparent plastic film for the manufacture of the hair tinting shield, suitable advertising messages and the like can be printed on the film. This can preferably be done on the end tab only so that in use there will be no printing on the main body of the bag to interfere with the hairdresser's view of the treatment. The hair tinting shield of this invention could well be used as a complimentary give away item in connection with the sale of hair treating solutions.

What is claimed is:

1. A hair processing shield comprising a tube of a flexible plastic film sized to fit over a human head and cover the hair thereon and having at least 2 hand tearable longitudinal lines of perforations therein at one end of said tube, which when two adjacent lines of perforations are torn with one end of the flap therebetween being freed permits said flap to be folded down to form a pocket the sides of which are open.

2. The shield of claim 1 wherein said film is clear and water insoluble and wherein said tube is sealed at one end along a line perpendicular to the axis of said cylinder.

3. The shield of claim 1 wherein said tube has an additional hand tearable circumferential line of perforations contiguous to said one end forming a tearable tab at said one end of said plastic film, said longitudinal lines of perforations terminating at said circumferential line of perforations.

4. The shield of claim 3 wherein said plastic film is a polyolefin film less than 0.003 inches thick; said circumferential line of perforations is within 3 inches of said one end and extends completely around said tube, there are at least 3 of said longitudinal lines of perforations having a length of at least 5 inches each and spaced apart at least 3 inches and said tube is a cylinder having a length and diameter of at least 10 inches each.

5. A bag adapted to cover a head of hair and facilitates treatment thereof comprising a tube of a clear flexible membrane open at one end and having a diameter sufficient to allow said tube to slip onto a human head and a length sufficient to encase the hair on said human head, said flexible membrane being readily penetrable by a small hook which hook is adapted to pull hair through the resulting puncture in said flexible membrane, said tube having a circumferential line of perforations that can be parted by hand near the end opposite said one end and forming thereby a tearable end tab, and at least 3 spaced apart longitudinal lines of like perforations extending from said circumferential line towards the mid-portion of said tube.

6. The bag of claim 5 wherein there are at least 4 of said longitudinal lines, spaced at least 3 inches apart.

7. A hair treating method comprising placing a flexible plastic bag over a head of hair, said bag being open at one end and having longitudinal lines of hand tearable perforations near the other end, creating a puncture in said bag, pulling a tuft of hair through said opening, applying a fluid treating agent to said tuft, tearing two of said longitudinal lines that are adjacent and continguous to said tuft and creating a tab free at the upper end thereof, folding said upper end of said tab down and over said tuft forming a pouch thereabout, allowing treatment of said tuft in said pouch to continue, then opening said pouch and removing said bag from said head.

8. The method of claim 7 wherein said bag is sealed by a line of heat sealing at said other end, wherein there is a circumferential line of hand tearable perforations below said line of heat sealing and creating a tearable end tab that is inclusive of said line of heat sealing, said longitudinal lines terminating at said circumferential line, and wherein said end tab is torn off and disposed of prior to freeing said tab.

* * * * *